US011796966B2

(12) United States Patent
Jeanneret et al.

(10) Patent No.: US 11,796,966 B2
(45) Date of Patent: Oct. 24, 2023

(54) METHOD FOR PRODUCING A SILICON-BASED TIMEPIECE SPRING

(71) Applicant: PATEK PHILIPPE SA GENEVE, Geneva (CH)

(72) Inventors: Sylvain Jeanneret, Colombier (CH); Frédéric Maier, Neuchâtel (CH); Jean-Luc Bucaille, Présilly (FR)

(73) Assignee: PATEK PHILIPPE SA GENEVE, Geneva (CH)

( * ) Notice: Subject to any disclaimer, the term of this patent is extended or adjusted under 35 U.S.C. 154(b) by 590 days.

(21) Appl. No.: 17/047,936

(22) PCT Filed: Dec. 18, 2018

(86) PCT No.: PCT/IB2018/060218

§ 371 (c)(1),
(2) Date: Oct. 15, 2020

(87) PCT Pub. No.: WO2019/202378

PCT Pub. Date: Oct. 24, 2019

(65) Prior Publication Data

US 2021/0109483 A1 Apr. 15, 2021

(30) Foreign Application Priority Data

Apr. 16, 2018 (EP) ..... 18167501

(51) Int. Cl.
*G04D 3/00* (2006.01)
*G04B 1/14* (2006.01)
(Continued)

(52) U.S. Cl.
CPC ..... *G04D 3/0069* (2013.01); *G04B 1/145* (2013.01); *G04B 17/066* (2013.01); *G04B 21/06* (2013.01);
(Continued)

(58) Field of Classification Search
CPC .. G04D 3/0069; G04D 3/0076; G04D 3/0089; G04B 1/145; G04B 17/066
See application file for complete search history.

(56) References Cited

U.S. PATENT DOCUMENTS 8,622,611 B2 1/2014 Buhler et al.
9,428,382 B2 8/2016 Hessler
(Continued)

FOREIGN PATENT DOCUMENTS

CH 698 962 A2 12/2009
CH 699476 3/2010
(Continued)

OTHER PUBLICATIONS

Search Report issued in Taiwanese Patent Application No. 108110063 dated Jul. 28, 2022.
(Continued)

*Primary Examiner* — Binh X Tran
(74) *Attorney, Agent, or Firm* — NIXON & VANDERHYE

(57) ABSTRACT

A method for producing a timepiece spring includes the following steps: producing a piece based on silicon, having the desired shape of the timepiece spring; thermally oxidising the piece; deoxidising the piece; annealing the piece in a reducing atmosphere; forming a silicon oxide layer on the piece.

20 Claims, 3 Drawing Sheets

(51) Int. Cl.
*G04B 17/06* (2006.01)
*G04B 21/06* (2006.01)

(52) U.S. Cl.
CPC ..... *G04D 3/0076* (2013.01); *G04D 3/0089* (2013.01)

(56) References Cited

U.S. PATENT DOCUMENTS

| | | | | |
|---|---|---|---|---|
| 2009/0245030 | A1* | 10/2009 | Buhler | G04B 17/066 368/177 |
| 2011/0310711 | A1* | 12/2011 | Bifrare | G04B 17/227 216/33 |
| 2015/0309474 | A1 | 10/2015 | Bossart et al. | |
| 2016/0238994 | A1* | 8/2016 | Ching | C30B 29/06 |
| 2017/0176941 | A1* | 6/2017 | Kohler | B81C 1/00 |
| 2017/0285573 | A1* | 10/2017 | Manousos | G04B 19/12 |

FOREIGN PATENT DOCUMENTS

| | | | |
|---|---|---|---|
| CH | 702 431 | A2 | 6/2011 |
| CH | 704 471 | A2 | 8/2012 |
| CH | 706020 | | 7/2013 |
| CH | 705 368 | B1 | 11/2015 |
| CH | 704 391 | B1 | 1/2016 |
| CN | 105182721 | A | 12/2015 |
| DE | 10 2009 014 442 | A1 | 9/2010 |
| EP | 2 277 822 | A1 | 1/2011 |
| JP | 2015-210270 | A | 11/2015 |
| JP | 2016-173356 | A | 9/2016 |
| JP | 2017-44543 | A | 3/2017 |
| JP | 2017-111131 | | 6/2017 |
| TW | I463282 | B | 12/2014 |
| WO | 2007/000271 | A1 | 1/2007 |
| WO | 2017/055983 | A1 | 4/2017 |

OTHER PUBLICATIONS

International Search Report for PCT/IB2018/060218 dated Apr. 4, 2019, 4 pages.
Written Opinion of the ISA for PCT/IB2018/060218 dated Apr. 4, 2019, 5 pages.

* cited by examiner

METHOD FOR PRODUCING A SILICON-BASED TIMEPIECE SPRING

CROSS-REFERENCE TO RELATED APPLICATIONS

This application is the U.S. national phase of International Application No. PCT/IB2018/060218 filed Dec. 18, 2018 which designated the U.S. and claims priority to EP Patent Application No. 18167501.8 filed Apr. 16, 2018, the entire contents of each of which are hereby incorporated by reference.

BACKGROUND OF THE INVENTION

Field of the Invention

The present invention relates to a method for producing a silicon-based timepiece spring, in particular for a wristwatch or pocket watch.

Description of the Related Art

Silicon is a highly-prized material in mechanical watchmaking owing to its advantageous properties, in particular its low density, its high level of resistance to corrosion, its non-magnetic nature and its suitability for machining by micro-fabrication techniques. It is thus used to produce hairsprings, balances, oscillators with flexible guidance, escapement anchors and escape wheels.

However, silicon has the disadvantage of low mechanical strength, a disadvantage which is made worse by the method of etching generally used to machine it, i.e. deep reactive ion etching, DRIE, which leaves sharp edges and creates defects in flatness in the form of wavelets (scalloping) as well as defects in the crystalline unit cell, on the flanks of the piece. This low mechanical strength is problematic for the handling of components during mounting in the movement or if the watch is subjected to shocks. In fact, the components can easily break. In order to solve this problem, silicon timepiece components are generally strengthened with a silicon oxide coating with a thickness very greater than that of the native oxide, as described in patent application WO 2007/000271. This coating is generally left on the final component but, according to the teaching of patent application EP 2277822, it can be removed without substantially affecting mechanical strength.

In the case of springs, mechanical strength must also be of such a level that the component can deform elastically without breaking during operation in order to carry out its function. For a hairspring intended to be fitted to a balance or for the flexible guidance of an oscillator without pivots, the operating stresses are of a relatively low level, of the order of some hundreds of MPa at most, so that the mechanical strength provided by the silicon oxide layer can be sufficient in theory. However, taking account of the oscillation frequencies during operation (4 Hz, 10 Hz or even 50 Hz) the number of cycles is high, which can cause breakage risks owing to fatigue. For other springs such as mainsprings, in particular barrel springs, or some hammer or rocker springs, the stresses undergone during operation thereof are much greater, of the order of some GPa, and are incompatible with the choice of silicon as the production material, even when covered with silicon oxide. This is why, for this type of spring, materials with a high elastic limit are chosen or proposed, such as steels, nickel-phosphorous alloys, Nivaflex® (alloy based on Co, Ni, Cr and Fe having an elastic limit of about 3.7 GPa), metallic glasses (see patents CH 698962 and CH 704391) or composite metal/diamond or metalloid/diamond materials (see patent CH 706020 of the applicant).

An alternative to the formation of a silicon oxide layer on the silicon is described in patent application CH 702431. It consists of carrying out annealing of the component in a reducing atmosphere in order to round off the edges and attenuate the defects in flatness of the flanks created by the DRIE. This method is inadequate for springs intended to absorb high levels of stress during operation and does not provide optimal fatigue strength.

SUMMARY OF THE INVENTION

The present invention aims to substantially increase the maximum level of stress which a silicon-based timepiece spring is able to undergo during operation and/or the fatigue strength of such a timepiece spring.

For this purpose, according to a first embodiment of the invention, a method for producing a timepiece spring is proposed comprising the following steps:

a) producing a piece based on silicon, having the desired shape of the timepiece spring or comprising a part having the desired shape of the timepiece spring,
b) thermally oxidising the piece,
c) deoxidising the piece,
d) annealing the piece in a reducing atmosphere,
e) forming a silicon oxide layer on the piece.

According to a second embodiment of the invention, a method for producing a timepiece spring is proposed comprising the following steps:

a) producing a piece based on silicon, having the desired shape of the timepiece spring or comprising a part having the desired shape of the timepiece spring,
b) annealing the piece in a reducing atmosphere,
c) thermally oxidising the piece,
d) deoxidising the piece,
e) forming a silicon oxide layer on the piece.

BRIEF DESCRIPTION OF THE DRAWINGS

Other features and advantages of the present invention will become clear upon reading the following detailed description given with reference to the attached drawings in which.

DESCRIPTION OF THE PREFERRED EMBODIMENTS

Figure 1:
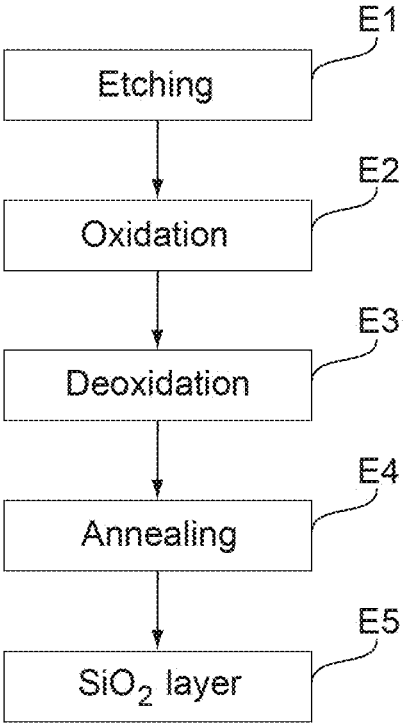
FIG. 1 is a diagram showing the different steps of a method of production in accordance with one particular embodiment of the invention.

With reference to FIG. 1, a particular embodiment of the method for producing a silicon-based timepiece spring in accordance with the invention comprises steps E1 to E5.

A first step, E1, consists of etching in a silicon wafer, preferably by deep reactive ion etching (DRIE), a piece having the desired shape and substantially the desired dimensions of the timepiece spring, or a piece with a part having the desired shape and substantially the desired dimensions of the timepiece spring.

The silicon can be monocrystalline, polycrystalline or amorphous. Polycrystalline silicon may be preferred to achieve isotropy of all the physical characteristics. Moreover, the silicon used in the invention may or may not be doped. Instead of silicon specifically, the piece can be produced from a composite material comprising thick layers of silicon separated by one or more thin intermediate layers of silicon oxide, by etching in a silicon-on-insulator substrate (SOI substrate).

A second step, E2, of the method consists of thermally oxidising the piece, typically at a temperature between 600° C. and 1300° C., preferably between 800° C. and 1200° C., so as to cover it with a silicon oxide ($SiO_2$) layer. The thickness of this silicon oxide layer is typically between 0.5 μm and some micrometres, preferably between 0.5 and 5 μm, more preferably between 1 and 5 μm, e.g. between 1 and 3 μm. This silicon oxide layer is formed by growth, with silicon being consumed, which causes the interface between the silicon and the silicon oxide to retreat and attenuates the surface defects of the silicon.

In a third step, E3, the silicon oxide layer is removed, e.g. by wet etching, vapour phase etching or dry etching.

In a fourth step, E4, the annealing treatment described in patent application CH 702431, which is incorporated into the present application by reference, is applied to the piece. This annealing treatment (thermal annealing) is carried out in a reducing atmosphere, preferably at a pressure strictly above 50 Torr, or even above 100 Torr, and less than or equal to atmospheric pressure (760 Torr), but which can be of the order of atmospheric pressure, and preferably at a temperature between 800° C. and 1300° C. The annealing treatment can last from some minutes to several hours. The reducing atmosphere can be formed mainly or entirely of hydrogen. It can also include argon, nitrogen or any other inert gas. This annealing treatment causes a migration of silicon atoms which leave convex parts of the surface to collect in concave parts and thus to round off the edges and to attenuate the wavelets and other defects left on the flanks by the etching process.

In a fifth step, E5, of the method, a layer of silicon oxide ($SiO_2$) is formed on the piece, enabling its mechanical strength to be increased. This silicon oxide layer can be formed by thermal oxidation in the same way as in the second step E2 or by deposition, in particular chemical or physical vapour phase deposition (CVD, PVD). It is preferably formed on all or nearly all the surface of the piece. Its thickness is typically between 0.5 μm and some micrometres, preferably between 0.5 and 5 μm, more preferably between 1 and 5 μm, e.g. between 1 and 3 μm.

Said piece typically forms part of a batch of pieces produced in a single silicon wafer. In a final step of the method, the piece and the other pieces of the batch are detached from the wafer. The finished timepiece spring in accordance with the invention can be the detached piece itself or a part of this piece.

It has unexpectedly been found that the oxidation-deoxidation (steps E2 and E3), the annealing (step E4) and the formation of a silicon oxide layer (step E5) complement each other remarkably well so that the overall effect obtained very clearly exceeds that which could be expected in combining these steps.

Figure 2:
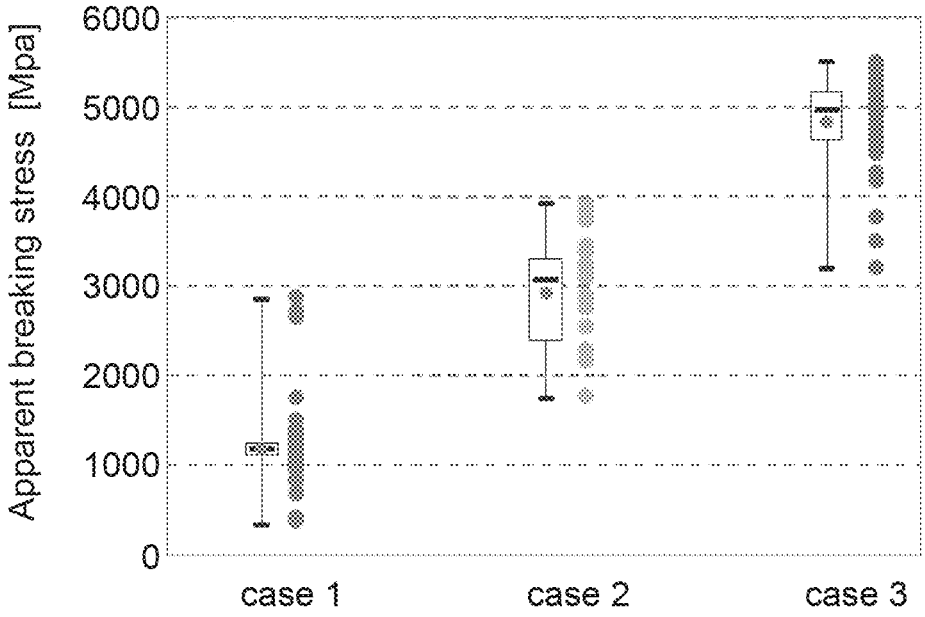
FIG. 2 is a graph showing, by means of points and box plots, apparent breaking stress values obtained in three different cases.

FIG. 2 shows the apparent breaking stress under flexing measured over several tens of test pieces in different cases, i.e.:

- case 1: test pieces produced only by DRIE (step E1 only),
- case 2: test pieces produced by DRIE and coated with a silicon oxide layer of about 3 μm in thickness (steps E1 and E5 only), these test pieces being produced from the same silicon wafer as that of case 1,
- case 3: test pieces produced by the method in accordance with the invention (steps E1 to E5), the silicon oxide layer formed in step E5 having a thickness of about 3 μm, these test pieces being produced from the same silicon wafer as those of cases 1 and 2.

The apparent breaking stress under flexing obtained with the method in accordance with the invention is very high. It is on average of the order of 5 GPa, can even reach values close to 6 GPa and the minimum value is greater than 3 GPa. Since silicon is a fragile material, its apparent breaking stress or breaking limit coincides with its elastic limit. Consequently it is possible to produce silicon springs which are capable, during ordinary operation, to exert high-intensity forces, in the manner of springs produced from the most high-performance alloys or from metallic glass.

Figure 3:
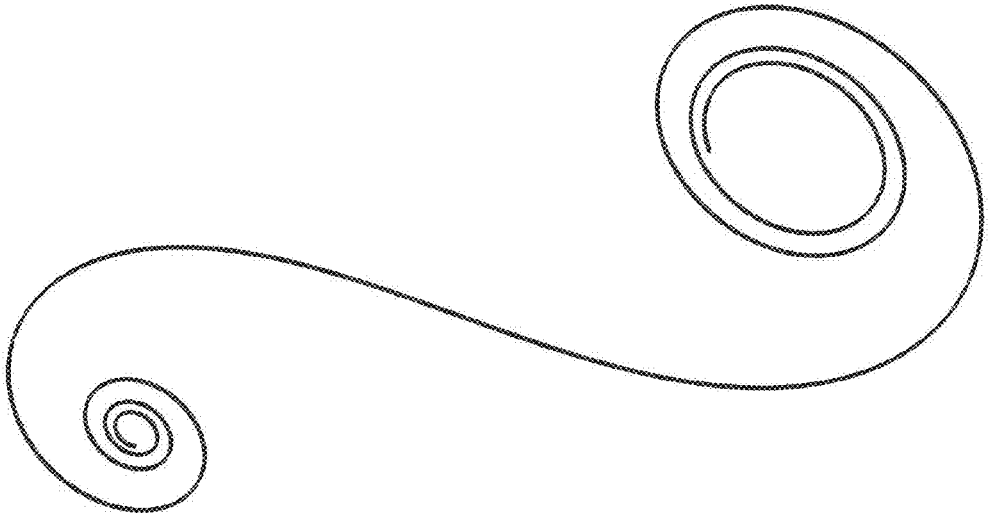
FIG. 3 is a view from above of a barrel spring produced by the method in accordance with the invention, the barrel spring being shown in the loosened state prior to introduction thereof into the barrel.

By way of example, FIG. 3 illustrates a mainspring, more precisely a barrel spring, intended to store mechanical energy as it is being wound and to progressively release it to power the operation of a gear train or other timepiece mechanism. Such a mainspring produced by the method in accordance with the invention will have an excellent energy storage capability, determined by the ratio of the squared elastic limit to the modulus of elasticity ($\sigma^2/E$). This mainspring, illustrated in FIG. 3 in its loosened state when it is outside of the barrel, can comprise parts fulfilling additional functions with respect to the storage and release of energy, e.g. parts serving as a boss or clamp as described in patent CH 705368.

Figure 4:
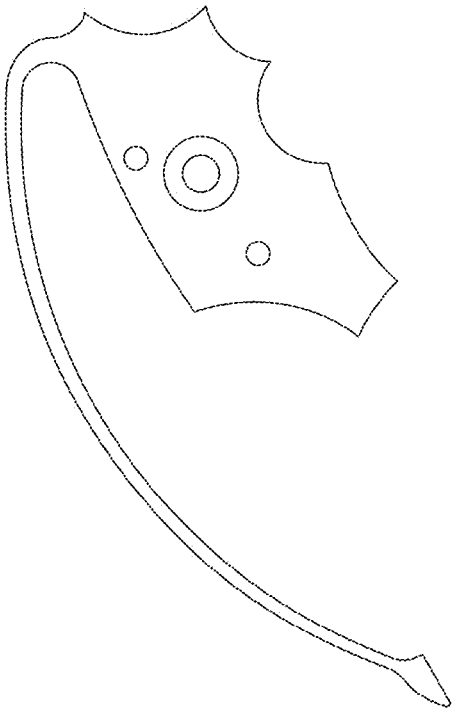
FIG. 4 is a view from above of a hammer spring produced by the method in accordance with the invention.

FIG. 4 illustrates a hammer spring, the end of which is intended to act on a pin borne by a hammer in order to actuate the latter so as to reset a chronograph counter. In the case of such a hammer spring or other springs, the very high apparent breaking stress under flexing obtained by the method in accordance with the invention can serve to reduce the dimensions of the spring with respect to a spring produced of a more conventional material such as steel or nickel-phosphorous for the same force exerted during ordinary operation.

It will be noted that the method in accordance with the invention can also be used to increase the fatigue strength of timepiece springs which apply forces of moderate intensity but which are used at a high frequency such as hairsprings fitted to balances or flexible guides of oscillators without pivots such as the flexible guide with separate crossed strips of the oscillator described in patent application WO 2017/055983.

In fact, it appears that the excellent complementarity of the treatments implemented by the method in accordance with the invention is due to the variety of physical phenomena involved. The oxidation-deoxidation removes the thickness of the silicon most affected by surface defects. The annealing reorganises the atoms in the material. The formation of the silicon oxide layer brings a compressive stress to the surface of the silicon. The result is that the timepiece springs obtained are of remarkable quality. The chipping and other defects likely to create incipient breaks are greatly reduced or even eliminated. The roughness of the surfaces is smoothed out. The wavelets and other surface defects created by the DRIE on the flanks of the piece are attenuated or even eliminated. The edges are rounded off, which reduces the concentration of stresses.

The method in accordance with the invention can be applied to timepiece springs other than those mentioned above, e.g. to rocker springs, lever springs, pawls springs or jumper springs.

In another embodiment of the invention, step E4 (annealing) is implemented before step E2 (thermal oxidation).

The invention claimed is:

1. Method for producing a timepiece spring, comprising the following steps:

a) producing a piece based on silicon, having the desired shape of the timepiece spring or comprising a part having the desired shape of the timepiece spring, b) thermally oxidising the piece, c) deoxidising the piece, d) annealing the piece in a reducing atmosphere, e) forming a silicon oxide layer on the piece.

2. The method as claimed in claim 1, wherein step a) comprises an etching operation.

3. The method as claimed in claim 1, wherein the thermal oxidation step is carried out at a temperature between 600° C. and 1300° C.

4. The method as claimed in claim 1, wherein the annealing step is carried out at a pressure strictly greater than 50 Torr.

5. The method as claimed in claim 1, wherein the annealing step is carried out at a pressure strictly greater than 100 Torr.

6. The method as claimed in claim 1, wherein the annealing step is carried out at a pressure lower than or equal to atmospheric pressure.

7. The method as claimed in claim 1, wherein the annealing step is carried out at a temperature between 800° C. and 1300° C.

8. The method as claimed in claim 1, wherein step e) is carried out by thermal oxidation.

9. The method as claimed in claim 1, wherein the silicon is monocrystalline or polycrystalline.

10. The method as claimed in claim 1, wherein step a) comprises a deep reactive etching operation.

11. The method as claimed in claim 1, wherein the thermal oxidation step is carried out at a temperature between 800° C. and 1200° C.

12. The method as claimed in claim 1, wherein the deoxidation step comprises an etching operation, a vapour phase etching operation or a dry etching operation.

13. The method of claim 12, wherein the deoxidation step comprises a wet etching operation.

14. The method as claimed in claim 1, wherein the timepiece spring is a mainspring, a hammer spring, a lever spring, a rocker spring, a pawl spring, a jumper spring, a hairspring or a flexible guide.

15. The method of claim 14, wherein the timepiece spring is a mainspring in the form of a barrel spring.

16. The method as claimed in claim 1, wherein said reducing atmosphere includes hydrogen.

17. The method as claimed in claim 16, wherein said reducing atmosphere also includes an inert gas.

18. The method of claim 17, wherein the inert gas is argon.

19. Method for producing a timepiece spring, comprising the following steps:

a) producing a piece based on silicon, having the desired shape of the timepiece spring or comprising a part having the desired shape of the timepiece spring, b) annealing the piece in a reducing atmosphere, c) thermally oxidising the piece, d) deoxidising the piece, e) forming a silicon oxide layer on the piece.

20. The method as claimed in claim 19, wherein step a) comprises an etching operation.

* * * * *